US008174485B2

(12) United States Patent
Jun et al.

(10) Patent No.: US 8,174,485 B2
(45) Date of Patent: May 8, 2012

(54) LIQUID CRYSTAL DISPLAY DEVICE AND DRIVING METHOD THEREOF

(75) Inventors: Chul Ju Jun, Gumi-si (KR); Min Hwa Kim, Gumi-si (KR); Rok Hee Lee, Seoul (KR); Myoung Hwa Lee, Ulsan-si (KR)

(73) Assignee: LG Display Co., Ltd., Seoul (KR)

( * ) Notice: Subject to any disclaimer, the term of this patent is extended or adjusted under 35 U.S.C. 154(b) by 706 days.

(21) Appl. No.: 12/318,056

(22) Filed: Dec. 19, 2008

(65) Prior Publication Data

US 2009/0289962 A1 Nov. 26, 2009

(30) Foreign Application Priority Data

May 21, 2008 (KR) ..... 10-2008-0047139

(51) Int. Cl.
*G09G 3/36* (2006.01)
*G09G 5/10* (2006.01)

(52) U.S. Cl. ..... 345/102; 345/690

(58) Field of Classification Search ..... 345/102
See application file for complete search history.

(56) References Cited

U.S. PATENT DOCUMENTS

| | | | | |
|---|---|---|---|---|
| 7,304,655 | B2 * | 12/2007 | Choi et al. | 345/690 |
| 2002/0067322 | A1 * | 6/2002 | Yanagawa et al. | 345/87 |
| 2005/0231457 | A1 * | 10/2005 | Yamamoto et al. | 345/102 |
| 2007/0222743 | A1 * | 9/2007 | Hirakata | 345/102 |

* cited by examiner

*Primary Examiner* — Alexander S Beck
*Assistant Examiner* — Joseph Pena
(74) *Attorney, Agent, or Firm* — McKenna Long & Aldridge, LLP

(57) ABSTRACT

The method of driving a liquid crystal display device includes calculating a brightness average value of pixel data of at least one frame period supplied to a liquid crystal display panel, and storing the average to a memory unit; generating a brightness control signal having a duty ratio according to the brightness average value of the pixel data adjusted taking variation of transmissivity with an angle of view into account in a white or black driving mode of the liquid crystal display panel; and supplying the brightness control signal to a light source unit.

9 Claims, 7 Drawing Sheets

LIQUID CRYSTAL DISPLAY DEVICE AND DRIVING METHOD THEREOF

This application claims the benefit of Korean Patent Application No. P2008-47139, filed on May 21, 2008, which is hereby incorporated by reference for all purposes as if fully set forth herein.

BACKGROUND OF THE INVENTION

1. Field of the Invention

The present invention relates to a liquid crystal display device, and more particularly, to a liquid crystal display device and a driving method thereof which can improve a display quality of a liquid crystal display panel.

2. Discussion of the Related Art

Generally, as one of information display modules, the importance of the liquid crystal display device (LCD) increases gradually following information orientation of the modern society.

Though the CRT (Cathode Ray Tube), which has been used the most widely, has many advantages in light of performance and price, the CRT had disadvantages in light of difficulty of making the device smaller, or portable. Opposite to this, it is a trend that a range of applications of the liquid crystal display device becomes wider gradually owing to features that the liquid crystal display device can be fabricated smaller, lighter, and thinner, and has low power consumption. The liquid crystal display device displays a desired image by applying an electric field to liquid crystals having an anisotropic dielectric between two substrates and controlling intensity of the electric field to control a quantity of light passing through the substrate.

Since the liquid crystal display panel of the liquid crystal display device is a non-light emitting device which cannot emit a light for itself, the liquid crystal display device is provided with a light source unit which provides the light to the liquid crystal display panel thereof.

The liquid crystal display panel has an intensive color distortion depending on an angle of view. That is, while a red brightness increases as the angle of view goes to a side, a blue brightness decreases as the angle of view goes to the side, the image appears reddish when the image is seen from the side. This problem becomes more intensive in a black driving mode or a white driving mode of the liquid crystal display panel when a variation of colors varied with an angle of view is intense, thereby impairing the display quality.

SUMMARY OF THE INVENTION

Accordingly, the present invention is directed to a liquid crystal display device and a driving method thereof.

An advantage of the present invention is to provide a liquid crystal display device and a driving method thereof which can improve a display quality of the liquid crystal display panel.

Additional advantages and features of the invention will be set forth in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, a liquid crystal display panel includes; a gate driving unit driving gate lines of the liquid crystal display panel; a data driving unit for driving data lines of the liquid crystal display panel; a timing controller for controlling the gate and data driving units and calculating an average brightness value of pixel data of at least one frame to be supplied to the liquid crystal display panel and storing the average brightness value to a memory unit; a light source unit including red, green, blue LEDs; and a light source driving unit including an LED brightness controlling unit for generating a brightness control signal having a duty ratio according to the average brightness value of the pixel data adjusted taking transmissivity at an angle of view in a white or black driving mode of the liquid crystal display panel, and driving the light source unit according to the brightness control signal.

In another aspect of the present invention, a method for driving a liquid crystal display device comprises calculating an brightness average value of pixel data of at least one frame period supplied to a liquid crystal display panel, and storing the average to a memory unit; generating a brightness control signal having a duty ratio according to the brightness average value of the pixel data adjusted taking variation of transmissivity with an angle of view into account in a white or black driving mode of the liquid crystal display panel; and supplying the brightness control signal to a light source unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiment(s) of the invention and together with the description serve to explain the principle of the invention. In the drawings.

DETAILED DESCRIPTION OF THE INVENTION

Reference will now be made in detail to embodiments of the present invention, examples of which are illustrated in the accompanying drawings FIGS. 1 to 8. Wherever possible, the same reference numbers will be used throughout the drawings to refer to the same or like parts.

Figure 1:
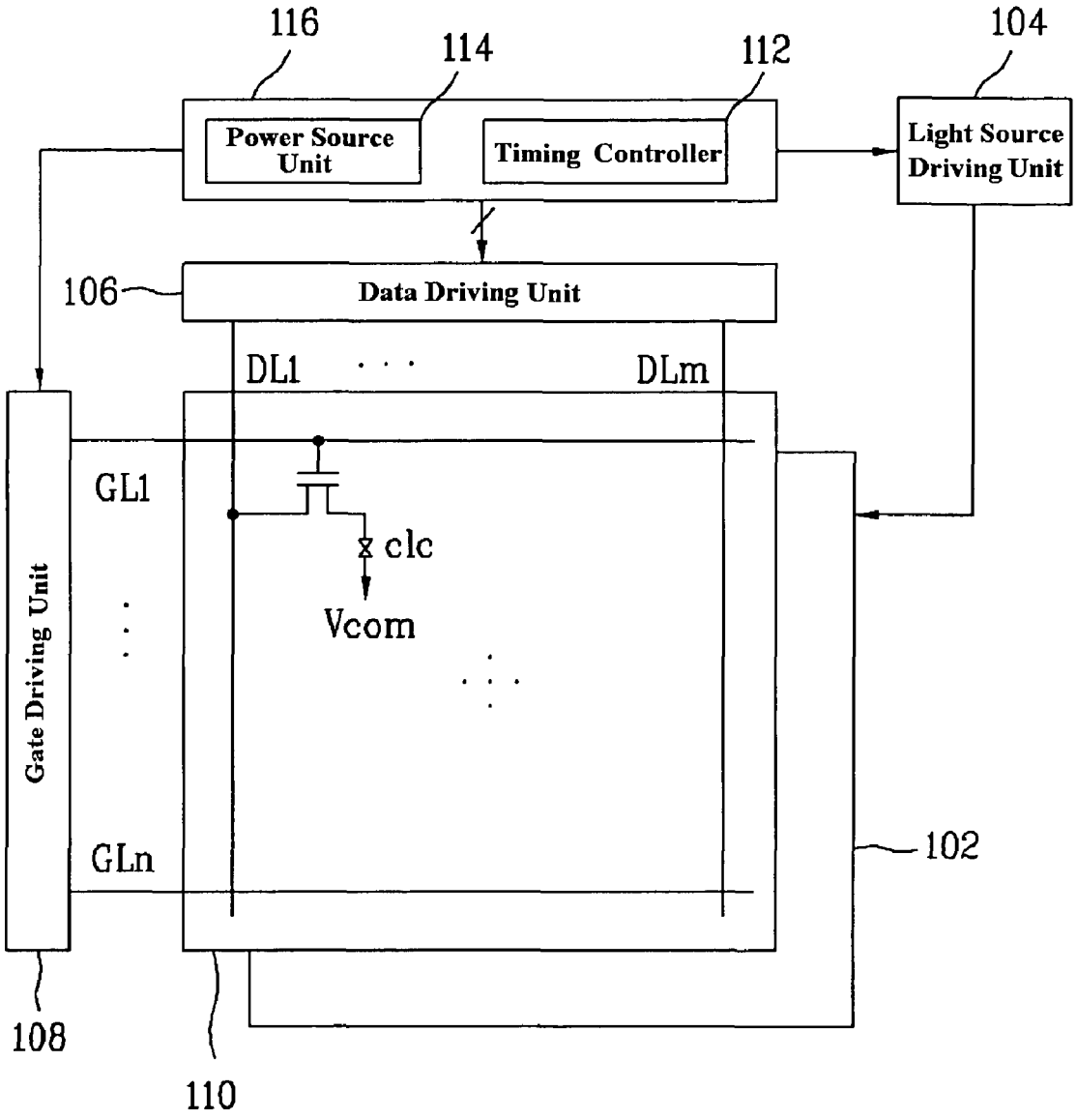
FIG. 1 illustrates a block diagram of a liquid crystal display device in accordance with an embodiment of the present invention.
Figure 2:
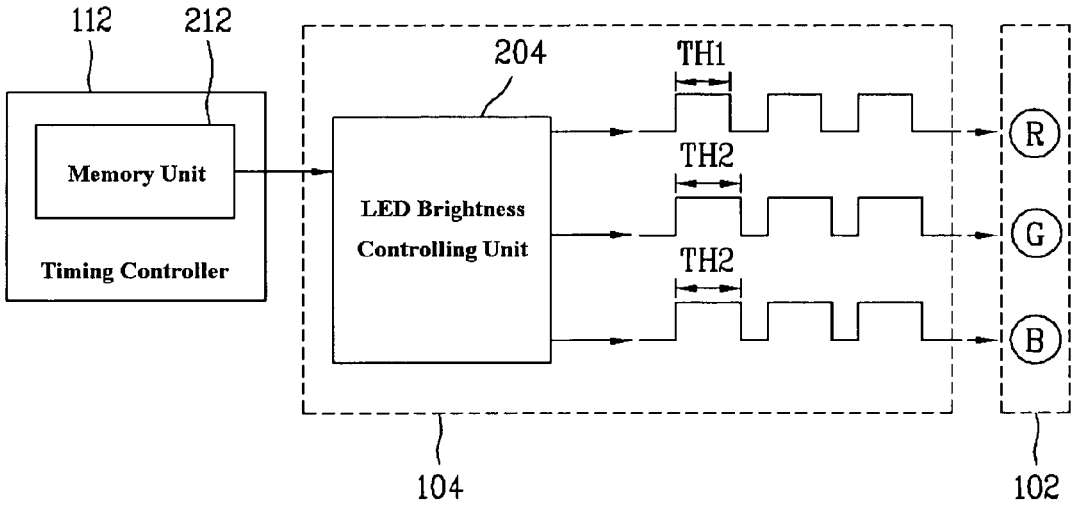
FIG. 2 illustrates a block diagram for explaining an LED brightness controlling unit at the time of a black driving mode of the liquid crystal display panel in FIG. 1.
Figure 3:
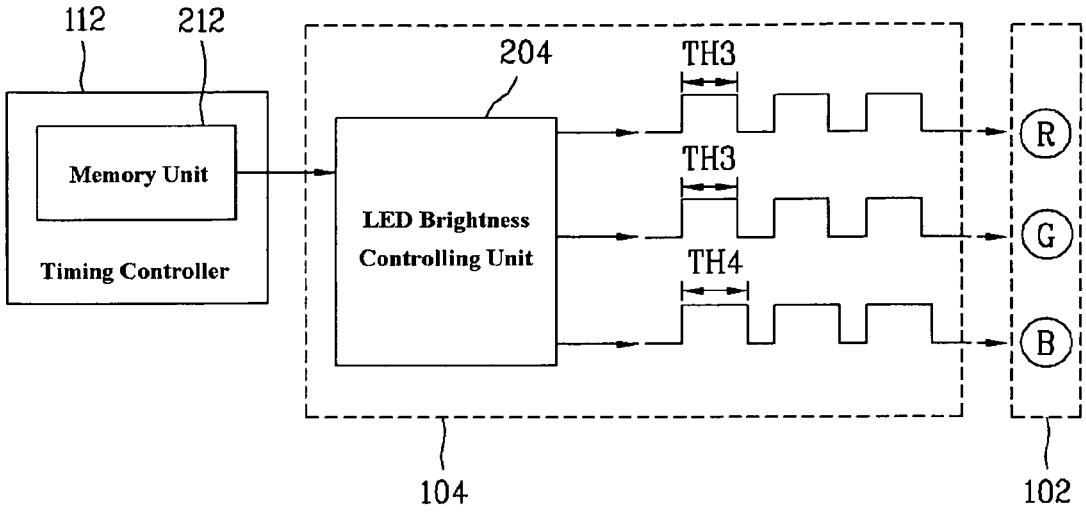
FIG. 3 illustrates a block diagram for explaining an LED brightness controlling unit at the time of a white driving mode of the liquid crystal display panel in FIG. 1.

FIG. 1 illustrates a block diagram of a liquid crystal display device in accordance with an embodiment of the present invention. FIG. 2 illustrates a block diagram explaining an LED brightness controlling unit at the time of a black driving mode of the liquid crystal display panel in FIG. 1, and FIG. 3 illustrates a block diagram explaining an LED brightness controlling unit at the time of a white driving mode of the liquid crystal display panel in FIG. 1.

Referring to FIG. 1, the liquid crystal display device includes a liquid crystal display panel 110 having a pixel matrix, a gate driving unit 108 for driving gate lines GL1~GLn of the liquid crystal display panel 110, a data driving unit 106 for driving data lines DL1~DLm of the liquid crystal display panel 110, and a timing controller 112 for controlling driving times of the gate driving unit 108 and the data driving unit 106.

The liquid crystal display panel 110 has a matrix of pixels formed at each region defined by the gate lines GL1~GLn and the data lines DL1~DLm crossing each other. Each of the pixels has a liquid crystal cell Clc for controlling a light transmission quantity in response to a pixel signal, and a thin film transistor TFT for driving the liquid crystal cell Clc.

The thin film transistor TFT is turned on when a gate on voltage Von is supplied to one of the gate lines GL1~GLn, to supply a pixel signal from the data line DL1~DLm to the liquid crystal cell Clc. The thin film transistor TFT is turned off when a gate-off voltage Voff is supplied to the gate line GL, to maintain the pixel signal charged at the liquid crystal cell Clc.

The liquid crystal cell Clc is represented with a capacitor as an equivalent device, and has a common electrode and a pixel electrode connected to the thin film transistor TFT facing each other with liquid crystals disposed therebetween. The liquid crystal cell Clc also has a storage capacitor (not shown) for sustaining the pixel signal charged thus until the next pixel signal is charged. The liquid crystal cell Clc expresses a gray scale as an orientation of the liquid crystals having anisotropic dielectric varies with the pixel signal charged thereto through the thin film transistor TFT.

The gate driving unit 108 shifts gate start pulses GSP from the timing controller 112 in response to a gate shift clock GSC, to supply scan pulses of the gate on voltage Von from a power source unit 114 to the gate lines GL1~GLn in succession. The gate driving unit 108 supplies the scan pulses of the gate on voltage Von to the gate lines GL1~GLn of the liquid crystal display panel 110.

The gate driving unit 108 supplies the gate off voltage Voff from the power source unit 114 in a period when The gate driving unit 108 does not supply the scan pulses of the gate on voltage Von to the gate lines GL1~GLn.

The gate driving unit 108 also controls a pulse width of the scan pulse in response to a gate output enable GOE signal from the timing controller 112.

The data driving unit 106 shifts a source start pulse SSP (not shown) from the timing controller 112 in response to a source shift clock SSC (not shown) to generate a sampling signal. The data driving unit 106 also latches pixel data RGB received in response to the SSC in response to the sampling signal, and supplies the pixel data RGB in line unit in response to a source output enable SOE signal. Then, the data driving unit 106 converts the pixel data RGB into analog pixel signals by using gamma voltages from a gamma voltage generating unit (not shown) and supplies analog pixel signals to the data lines DL. In this instance, the data driving unit 106 controls a polarity of each of the pixel signals in response to a polarity control signal POL from the timing controller 112 when the data driving unit 106 converts the pixel data into the pixel signal. The data driving unit 106 controls a period for supplying the pixel signals to the data lines DL1~DLm in response to the source enable signal SOE.

The power source unit 114 receives a driving voltage VDD from an outside of the liquid crystal display device and supplies the driving voltage VDD to the timing controller 112, the data driving unit 106, and the gate driving unit 106 which have digital circuits as a digital driving voltage. The power source unit 114 respectively generates the gate on voltage Von and the gate off voltage Voff by using the driving voltage VDD, and supplies to the gate driving unit 108, and generates and supplies a common voltage to the liquid crystal display panel 110.

The timing controller 112 generates a data control signal DCS for controlling the data driving unit 106 and a gate control signal GCS for controlling a gate driving unit 106 by using vertical and horizontal synchronizing signals V, H, a data enable signal DE, and a dot clock DCLK received from an outside. The data control signal DCS includes the source shift clock SSC, the source start pulse SSP, the polarity control signal POL, and the source output enable signal SOE. The gate control signal GCS includes the gate start pulse GSP, a clock signal RCLK, and the gate output enable signal GOE.

The timing controller 112 calculates an average brightness value of pixel data of one frame and stores the average brightness value to a memory unit 212. The memory unit 212 may be built in the timing controller 112 or provided separate from the timing controller 112.

The light source unit 102 is a plurality of light source arrays positioned in the rear of the liquid crystal display panel 110. The light source array includes red R, green G, and blue B LEDs. The light source arrays of the light source unit 102 are driven by a light source driving unit 104 to generate and provide a visible light with the liquid crystal display panel 110.

The light source driving unit 104 drives the light source unit 102 and eliminates a variation of colors varied with an angle of view. To do this, the light source driving unit 104 includes an LED brightness controlling unit 204.

In order to eliminate variation of color with the angle of view at the time of the white or black driving mode, the light source driving unit 104 generates a brightness control signal LCS for controlling a brightness, i.e., a light quantity of the red R, green G, and blue B LEDs. The light source unit 102 of LED causes a color distortion depending on the angle of view on a side of the display unit.

This is because, since the light quantity of the blue color B is decreased as the angle of view goes to the side the more while the light quantity of the red color R is increased as the angle of view goes to the side the more, the image appears reddish when the image is seen from the side. In this phenomenon, transmissivity of the red color R becomes the greater as the angle of view goes to the side in the black driving mode, and transmissivity of the blue color B becomes the smaller as the angle of view goes to the side in the white driving mode.

Figure 4:
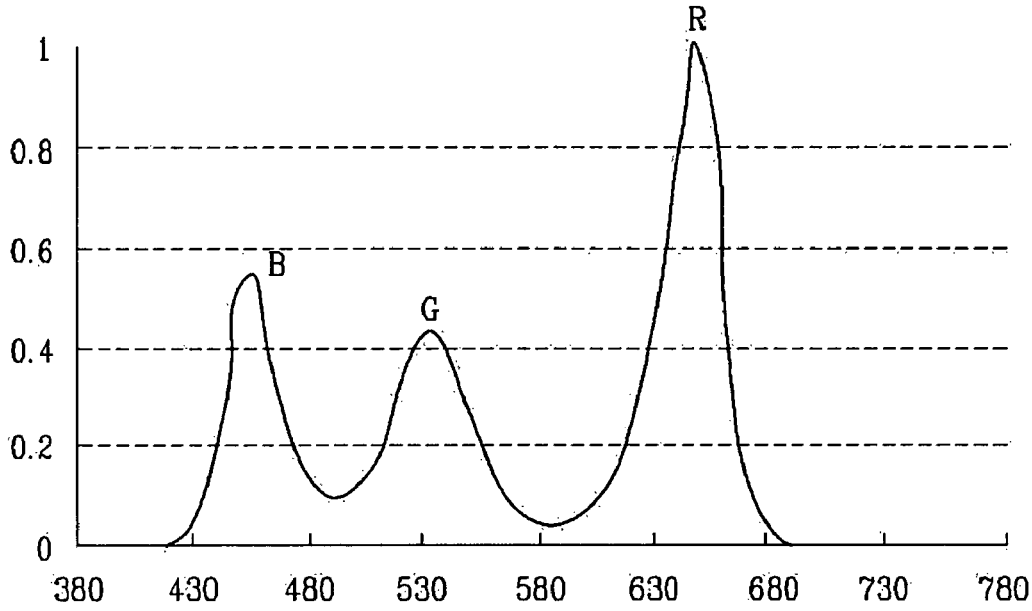
FIG. 4 illustrates a graph showing specific wavelengths of red R, green G, and blue B LEDS, respectively.

In detail, referring to FIG. 4, human being can see a color of the light when a wave length $\lambda$ of the light is within a visible light range of 380~730 nm, and the blue B, green G, and red R LEDs emit lights of specific wave lengths, respectively.

The blue B LED emits a blue light of a wave length below 465 nm, the green G LED emits a green light of a wave length in a range of 500 nm~630 nm, and the red R LED emits a red light of a wave length over 630 nm.

Figure 5:
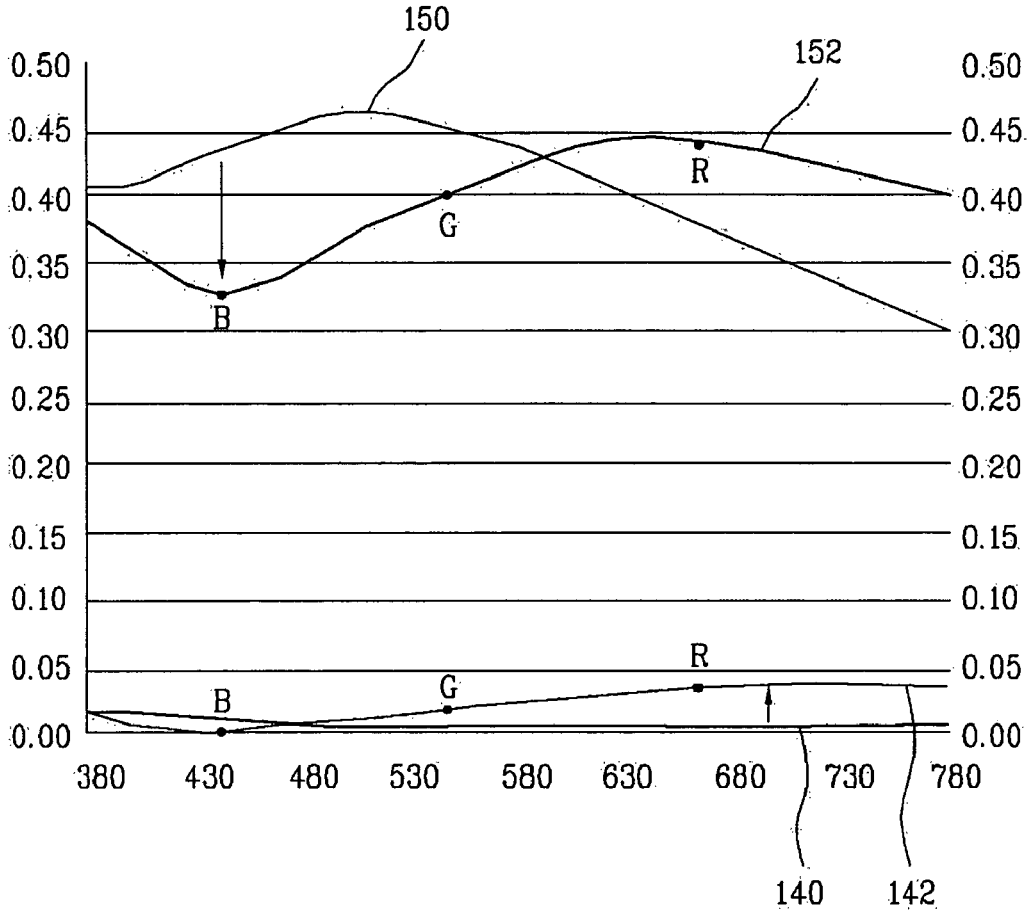
FIG. 5 illustrates a graph showing first to fourth curves which denote transmissivity vs. angle of view in white or black driving mode.

FIG. 5 illustrates a graph showing first to fourth curves 140, 142, 150, and 152 which denote transmissivity vs. angle of view in white or black mode drive, wherein X-axis denotes wavelength, and Y-axis denotes transmissivity.

The first curve 140 denotes transmissivity of the red R, green G, and blue B LEDs when the user looks at the image from a front of the display device driven in the black mode, and the second curve 142 denotes transmissivity of the red R, green G, and blue B LEDs when the user looks at the image from a side of the display device driven in the black mode.

The third curve 150 denotes transmissivity of the red R, green G, and blue B LEDs when the user looks at the image from a front of the display device driven in the white mode, and the fourth curve 152 denotes transmissivity of the red R, green G, and blue B LEDs when the user looks at the image from a side of the display device driven in the white mode.

Figure 6:
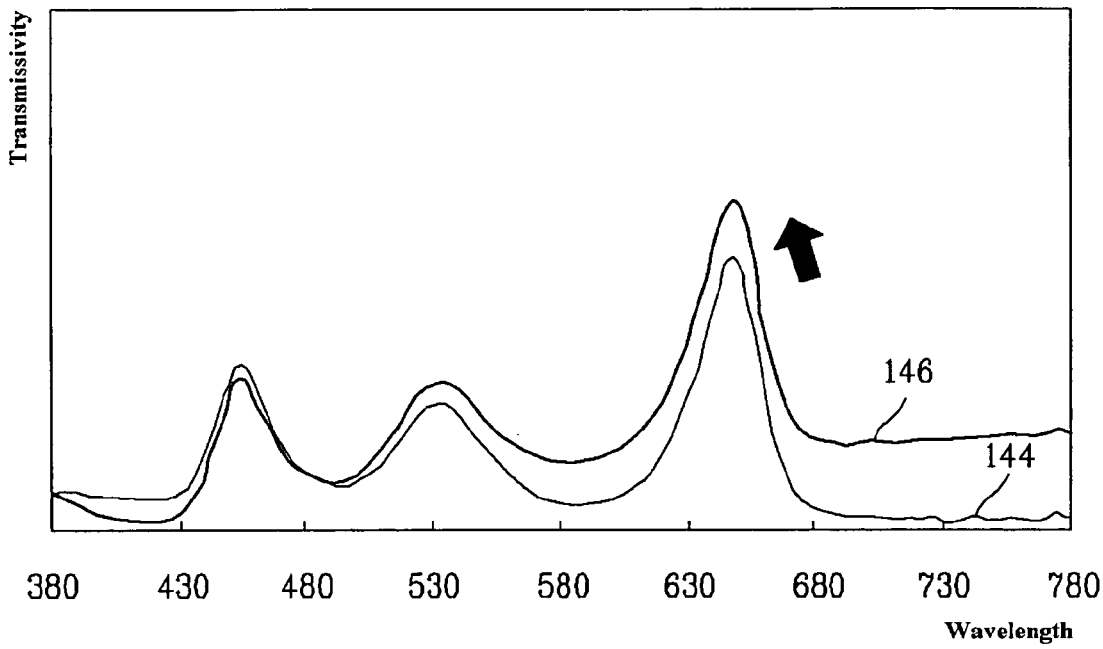
FIG. 6 illustrates a graph comparing two curves of variation of colors vs. angle of view in the black mode drive in FIG. 5.

FIG. 6 illustrates a graph comparing two curves of variation of colors vs. angle of view in the black mode drive in FIG. 5.

That is, the fifth curve 144 denotes wavelengths of the red R, green G, and blue B LEDs when the user looks at the image from the front of the display device driven in the black mode, and the sixth curve 146 denotes wavelengths of the red R, green G, and blue B LEDs when the user looks at the image from a side of the display device driven in the black mode.

Referring to FIGS. 5 and 6, it can be known that transmissivities of the red R LED have a difference between a time when the image is seen from a side and the image is seen from the front of the display device driven in the black mode.

That is, it can be known that the transmissivity of the red R LED becomes the greater as the angle of view goes from the front toward the side the more at the time of the black mode.

In order to reduce the variation of color with the angle of view in the black mode, the red brightness may be reduced. For this, the LED brightness controlling unit 204 generates and provides a red brightness control signal RLCS having a duty ratio adjusted for reducing the red R brightness which becomes the greater as much as the angle of view goes to the side the more at the time of the black mode.

Figure 7:
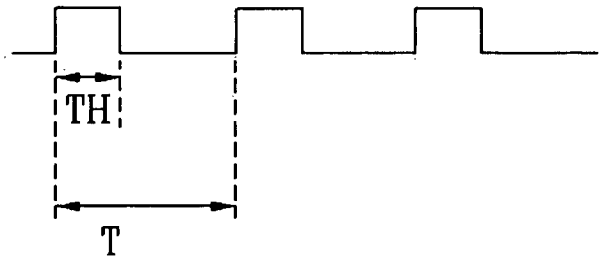
FIG. 7 illustrates a wave pattern showing a duty ratio of a pulse width.

Referring to FIG. 7, the duty ratio is a ratio of a high logic period (a pulse width; TH) to a period T. For example, if a 10V power has a 50% duty ratio, an average voltage thereof is 5V, and if the 10V power has a 75% duty ratio, the average voltage thereof is 7.5V. According to this, the LED brightness controlling unit 204 generates and provides the red brightness control signal RLCS having a duty ratio which becomes the smaller as much as the red R brightness becomes the greater in comparison to the red R brightness at an angle of view when the display device is seen from a front thereof to the light source unit 102 for reducing the red R brightness which becomes the greater as the angle of view goes to the side the more at the time of the black mode.

That is, the LED brightness controlling unit 204 adjusts the duty ratio of the red brightness control signal RLCS to be smaller for reducing an average value of a red pixel data received from the memory unit 212, and provides the signal adjusted thus to the light source unit 102, for reducing the brightness of the red R LED.

Figure 8:
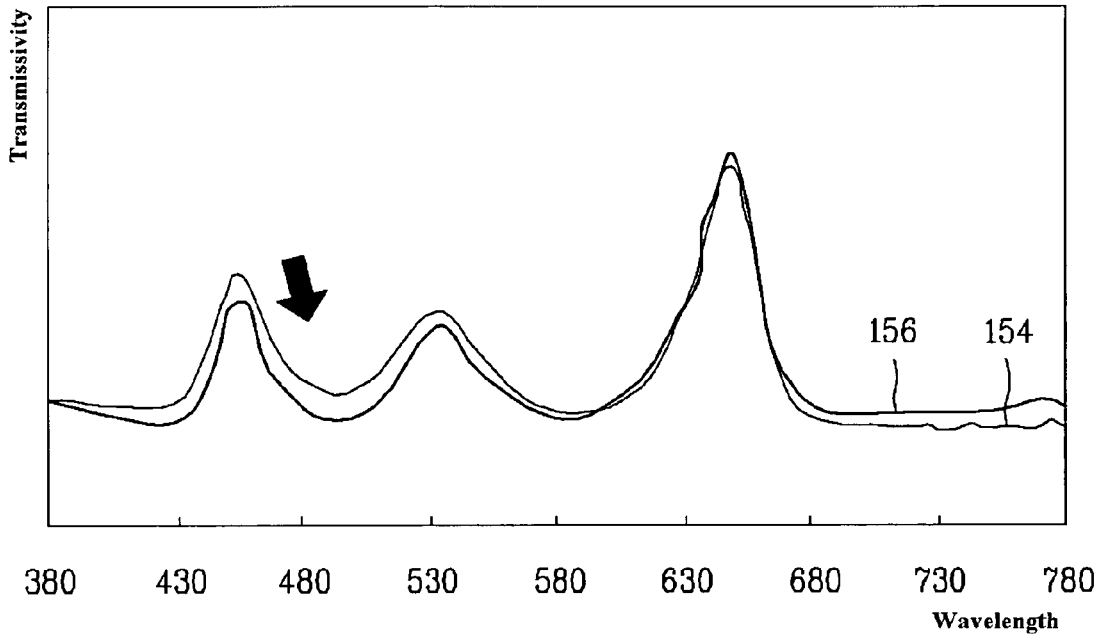
FIG. 8 illustrates a graph comparing two curves of variation of colors vs. angle of view in the white driving mode in FIG. 5.

FIG. 8 illustrates a graph comparing two curves of variation of colors vs. angle of view in the white mode drive in FIG. 5.

The seventh curve 154 denotes wavelengths of the red R, green G, and blue B LEDs when the user looks the image from the front of the display device driven in the white mode, and the eighth curve 156 denotes wavelengths of the red R, green G, and blue B LEDs when the user looks the image from the side of the display device driven in the white mode.

That is, it can be known that the transmissivity of the blue B LED becomes the greater as the angle of view goes from the front toward the side the more at the time of the white mode.

In order to reduce the variation of color with the angle of view in the white mode, a blue brightness may be varied. For this, the LED brightness controlling unit 204 provides a blue brightness control signal BLCS having a duty ratio thereof adjusted for making the blue brightness greater for preventing the blue brightness from becoming the smaller as the angle of view goes to the side the more at the time of white mode.

In other words, the LED brightness controlling unit 204 generates and provides the blue brightness control signal BLCS having a duty ratio which becomes the greater in comparison to the blue brightness at the angle of view when the display device is seen from front thereof for making the blue B brightness greater which becomes the smaller as the angle of view goes to the side the more at the time of the white mode.

That is, the LED brightness controlling unit 204 adjusts the duty ratio of the blue brightness control signal BLCS to be greater for making an average brightness value of blue pixel data received from the memory unit 212 greater, and provides the signal adjusted thus to the light source unit 102, for making the brightness of the blue B LED greater.

According to this, the LED brightness controlling unit 204 generates the red brightness control signal RLCS having a small duty ratio and provides to the light source unit 102 in the black mode, and generates the blue brightness control signal BLCS having a great duty ratio and provides to the light source unit 102 in the white mode, for reducing the variation of color at the angle of view on the side.

In the meantime, the LED brightness controlling unit 204, not only makes the red R brightness smaller by making the duty ratio of the red brightness control signal RLCS smaller in the black mode, but also, if the blue B and the green G colors are seen when the front angle of view and the side angel of view are compared, generates blue and green brightness control signals having duty rates thereof made smaller respectively taking a difference of transmissivities of the blue and green colors respectively into account, and provides to the light source unit 102.

Also, the LED brightness controlling unit 204, not only makes the blue brightness smaller by making the duty ratio of the blue brightness control signal BLCS smaller in the white mode, but also, if the red R and the green G colors are seen when the front angle of view and the side angel of view are compared, generates red and green brightness control signals having duty rates thereof made smaller respectively taking a difference of transmissivities of the red R and green G colors respectively into account, and provides to the light source unit 102.

Thus, the LED brightness controlling unit 204 can eliminate the image appeared reddish by making the red brightness smaller even in the white mode.

FIGS. 2 and 3 illustrate block diagrams each for explaining a method for driving a liquid crystal display device for reducing the variation of color with the angle of view in accordance with a preferred embodiment of the present invention.

Referring to FIG. 2, the method for driving a liquid crystal display device in a black mode includes the steps of calculating an average brightness value of pixel data of at least one frame period supplied to the liquid crystal display panel 110, and storing the average brightness value to a memory unit 212, generating a brightness control signal LCS taking variation of transmissivities of red R, green G, and blue B LEDs with an angle of view into account, and supplying the brightness control signal LCS to a light source unit 102.

In detail, the timing controller 112 calculates the average brightness value of pixel data of at least one frame supplied to the liquid crystal display panel 110 and stores the average brightness value to the memory unit 212. The average brightness value of the pixel data is supplied to the LED brightness controlling unit 204 of the light source driving unit 104.

Then, the LED brightness controlling unit 204 generates the brightness control signal LCS taking variation of transmissivities of red R, green G, and blue B LEDs with an angle of view into account in the black mode.

That is, in the black mode, the red color R transmissivity at a side angle of view and the red color R transmissivity at a front angle of view are different from each other. Since the red color R transmissivity at a side angle of view has a greater light quantity than the red color R transmissivity at a front angle of view, the LED brightness controlling unit 204 supplies a red brightness control signal RLCS generated by making a duty ratio of red pixel data of one frame smaller to the light source unit 102.

That is, the red brightness control signal RLCS has a value smaller than the average brightness value of the red pixel data among the averages of the red R, green G, and blue B pixel data supplied from the memory unit 212. The duty ratio adjusts the transmissivities at the front angle of view and the side angle of view in the black mode as much as a difference of light quantities compared thus.

Thus, the light source unit 102 receives the red brightness control signal RLCS from the LED brightness control unit 204. Eventually, the liquid crystal display panel 110 can eliminate the reddish phenomenon in which the image appears reddish as the angle of view goes to the side in the black mode owing to the red brightness control signal RLCS having a duty ratio thereof adjusted.

Referring to FIG. 3, the method for driving a liquid crystal display device in a white mode includes the steps of calculating an average brightness value of pixel data of at least one frame period supplied to the liquid crystal display panel 110, and storing the average to a memory unit 212, generating a brightness control signal LCS taking variation of transmissivities of red R, green G, and blue B LEDs with an angle of view into account, and supplying the brightness control signal LCS to a light source unit 102.

In detail, the timing controller 112 calculates the average brightness value of the pixel data of at least one frame supplied to the liquid crystal display panel 110 and stores the average brightness value to the memory unit 212. The average brightness value of the pixel data is supplied to the LED brightness controlling unit 204 of the light source driving unit 104.

Then, the LED brightness controlling unit 204 generates the brightness control signal LCS taking variation of transmissivities of red R, green G, and blue B LEDs with an angle of view into account in the white mode.

That is, in the white mode, the blue color B transmissivity at a side angle of view and the blue color B transmissivity at a front angle of view are different from each other. Since the blue color B transmissivity at a side angle of view has a smaller light quantity than the blue color B transmissivity at a front angle of view, the LED brightness controlling unit 204 supplies a blue brightness control signal BLCS generated by making a duty ratio of blue pixel data of one frame greater to the light source unit 102.

That is, the blue brightness control signal BLCS has a value greater than the average brightness value of the blue pixel data among the averages of the red R, green G, and blue B pixel data supplied from the memory unit 212.

Thus, the light source unit 102 receives the blue brightness control signal BLCS from the LED brightness control unit 204. Eventually, the liquid crystal display panel 110 can eliminate the phenomenon in which the image has the blue color reduced as the angle of view goes to the side in the white mode owing to the blue brightness control signal BLCS having a duty ratio thereof adjusted.

As has been described, in the liquid crystal display device and a driving method thereof of the present invention, the brightness control signal is generated by adjusting the duty ratio for reducing variation of color with the angle of view in the white or black mode, and provided to the light source unit.

According to this, not only the reddish phenomenon can be eliminated, in which the image appears reddish as the angle of view goes to the side, but also reduce the variation of color with the angle of view in the white or black mode of the liquid crystal display panel, thereby improving a display quality.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A liquid crystal display device comprising:

a liquid crystal display panel;

a gate driving unit driving gate lines of the liquid crystal display panel;

a data driving unit for driving data lines of the liquid crystal display panel; a timing controller for controlling the gate and data driving units and calculating an average brightness value of pixel data of at least one frame to be supplied to the liquid crystal display panel and storing the average brightness value to a memory unit;

a light source unit including red, green, blue LEDs; and a light source driving unit including an LED brightness controlling unit for generating a brightness control signal having a duty ratio according to the average brightness value of the pixel data adjusted taking transmissivity at an angle of view in a white or black driving mode of the liquid crystal display panel, and driving the light source unit according to the brightness control signal, wherein the LED brightness controlling unit controls the duty ratio for making a light quantity of at least one of red, blue, and green colors which vary with the angle of view in the black driving mode greater or smaller than the brightness average value, and wherein the LED brightness controlling unit decreases the duty ratio of a red brightness control signal for making a light quantity of the red LED smaller than a red brightness average value in the black driving mode.

2. The liquid crystal display device according to claim 1, wherein the memory unit is built in the timing controller or provided separate from the timing controller.

3. The liquid crystal display device according to claim 1, wherein the LED brightness controlling unit controls the duty ratio for making a light quantity of one of red, blue, and green colors which vary with the angle of view in the white driving mode greater or smaller than the brightness average value.

4. The liquid crystal display device according to claim 3, wherein the LED brightness controlling unit increases the duty ratio of a blue brightness control signal for making a light quantity of the blue LED greater than a blue brightness average value in the white driving mode.

5. The liquid crystal display device according to claim 1, wherein the duty ratio is adjusted as much as the brightness difference between the front angle of view and the side angle.

6. A method for driving a liquid crystal display device comprising:

calculating an brightness average value of pixel data of at least one frame period supplied to a liquid crystal display panel, and storing the average to a memory unit;

generating a brightness control signal having a duty ratio according to the average brightness value of the pixel data adjusted taking transmissivity at an angle of view in a white or black driving mode of the liquid crystal display panel; and supplying the brightness control signal to a light source unit, wherein the duty ratio is controlled at an LED brightness controlling unit for making a light quantity of at least one of red, blue, and green colors which vary with the angle of view in the black driving mode greater or smaller than the average brightness value, and wherein the duty ratio of a red brightness control signal is decreased for making a light quantity of the red LED smaller than a red brightness average value in the black driving mode.

7. The method as claimed in claim 6, wherein the duty ratio is controlled at an LED brightness controlling unit for making a light quantity of at least one of red, blue, and green colors which vary with the angle of view in the white driving mode greater or smaller than the average brightness value.

8. The method according to claim 7, wherein the duty ratio of a blue brightness control signal is increased for making a light quantity of the blue LED greater than a blue brightness average value in the white driving mode.

9. The method according to claim 6, wherein the duty ratio is adjusted as much as the brightness difference between the front angle of view and the side angle.

* * * * *